United States Patent [19]

Hiraga et al.

[11] Patent Number: 4,970,952

[45] Date of Patent: Nov. 20, 1990

[54] DATE-STAMPING APPARATUS

[75] Inventors: Imao Hiraga, Chino; Masamori Uchikawa, Shiojiri; Makoto Mizuno, Aichi, all of Japan

[73] Assignee: Shachihata Industrial Co., Ltd., Japan

[21] Appl. No.: 479,357

[22] Filed: Feb. 13, 1990

[30] Foreign Application Priority Data

Feb. 14, 1989 [JP] Japan ..... 1-16162[U]

[51] Int. Cl.[5] ..... B41J 1/60

[52] U.S. Cl. ..... 101/111; 101/109

[58] Field of Search ..... 101/103, 105, 109, 111, 101/93.13, 333, 405

[56] References Cited

U.S. PATENT DOCUMENTS

| | | | |
|---|---|---|---|
| 3,504,622 | 4/1970 | Morrison | 101/99 |
| 3,796,152 | 3/1974 | Finke et al. | 101/111 |
| 4,170,938 | 10/1979 | Sato | 101/105 |
| 4,561,353 | 12/1985 | Chapman et al. | 101/111 |
| 4,858,526 | 8/1989 | Bengsson | 101/111 |

FOREIGN PATENT DOCUMENTS

| | | | |
|---|---|---|---|
| 220380 | 9/1987 | Japan | 101/111 |
| 64-52768 | 3/1989 | Japan . | |
| 1499348 | 1/1978 | United Kingdom | 101/111 |
| 2064435 | 6/1981 | United Kingdom | 101/111 |
| 2073107 | 3/1981 | United Kingdom . | |

*Primary Examiner*—Edgar S. Burr
*Assistant Examiner*—Ren Yan
*Attorney, Agent, or Firm*—Mason, Fenwick & Lawrence

[57] ABSTRACT

A date-stamping apparatus having a casing, a bridge member located at the lower end of the casing, a tension roller located above the casing and forced upwardly, an endless date-printing belt having printing letters on its outside surface and spanned between the bridge member and the tension roller, a date-belt driving wheel located within the casing at a substantially intermediate portion. The date of driving wheel has a circumferential engagement section co-operating with the belt and being contacted by the outside surface of the belt, and an electric motor intermittently energized by a timing circuit and operatively connected with the belt-driving wheel, so that stamped date is electrically adjusted.

3 Claims, 3 Drawing Sheets

DATE-STAMPING APPARATUS

BACKGROUND OF THE INVENTION

Field of the Industrial Application

The present invention relates to an electrically actuated date-stamping apparatus.

A type of date-stamping system is known from Japanese Patent Disclosure No. 58-211289 which includes an electric motor energized by clock signals at regular time intervals to perform the forward movement of printing belts automatically. In this system, printing belts are driven by an electric motor energized by a clock signals. If each of the printing belts has a smooth backface, it is difficult to make a positive advancement of that printing belts since there is slippage between the smooth backface of the printing belt and the surface of the corresponding pulley. In order to overcome this problem, a proposal is made in the above Patent Disclosure to roughened the backface of each printing belt. However, the roughened backface raises another problem in that an irregularity of density is created in the stamped characters and the characters are deformed.

A system in which printing characters are formed on the peripheral face of a disc formed with a gear wheel at the side of the disc is known from by Japanese Utility Model Disclosure No. 61-180751 and Japanese Patent Disclosure No. 85-233877. Although such a disc-type structure can positively overcome the aforementioned problem, each of the printing discs will necessarily have an increased external diameter when numerals corresponding to the days in one month are formed on the peripheral face of the disc. This will increase the overall size of the date-stamping device, and make it inconvenient to handle.

It is therefore an object of the present invention to provide a date-stamping apparatus in which no slippage results between each of belt-driving wheels and a corresponding endless printing belt.

It is a further an object of the present invention to provide a date-stamping apparatus which avoids any irregularity of density of the stamped characters and any deformation of the stamped characters, even if the character portion of the stamping belt is made from soft, cellular rubber to absorb ink.

It is another object of the present invention to provide a date-stamping apparatus in which, even if an endless printing belt is larger than the conventional belt, whole belt assembly can be easily housed in a compact casing.

SUMMARY OF THE INVENTION

According to the present invention, the above objects can be accomplished by a date-stamping apparatus comprising a casing, a bridge member located at the lower end of the casing, a tension roller located above the casing and forced upwardly, an endless date-printing belt having printing characters on its outside surface and spanned between the bridge member and the tension roller, a date-belt driving wheel located within the casing at a substantially intermediate portion thereof, having a circumferential engagement section co-operating with the belt and being contacted by the outside surface of the belt, and an electric motor intermittently energized by a timing circuit and operatively connected with the belt driving wheel.

In a preferred embodiment of the present invention, the printing characters are made from cellular rubber.

Another preferred embodiment of the present invention includes a time-printing belt and a time-belt driving wheel. The time-belt driving wheel is connected with an electric motor and the belt driving wheel is connected with the time-belt driving wheel through a carrying wheel, which makes the belt driving wheel rotate by an amount corresponding to one day when the time-belt driving wheel is driven by an amount corresponding to 24 hours.

Further objects, features and advantages of the present invention will become apparent from the following DETAILED DESCRIPTION OF THE PREFERRED EMBODIMENT and the attached figures of drawing.

DETAILED DESCRIPTION OF THE PREFERRED EMBODIMENTS

Figure 1:
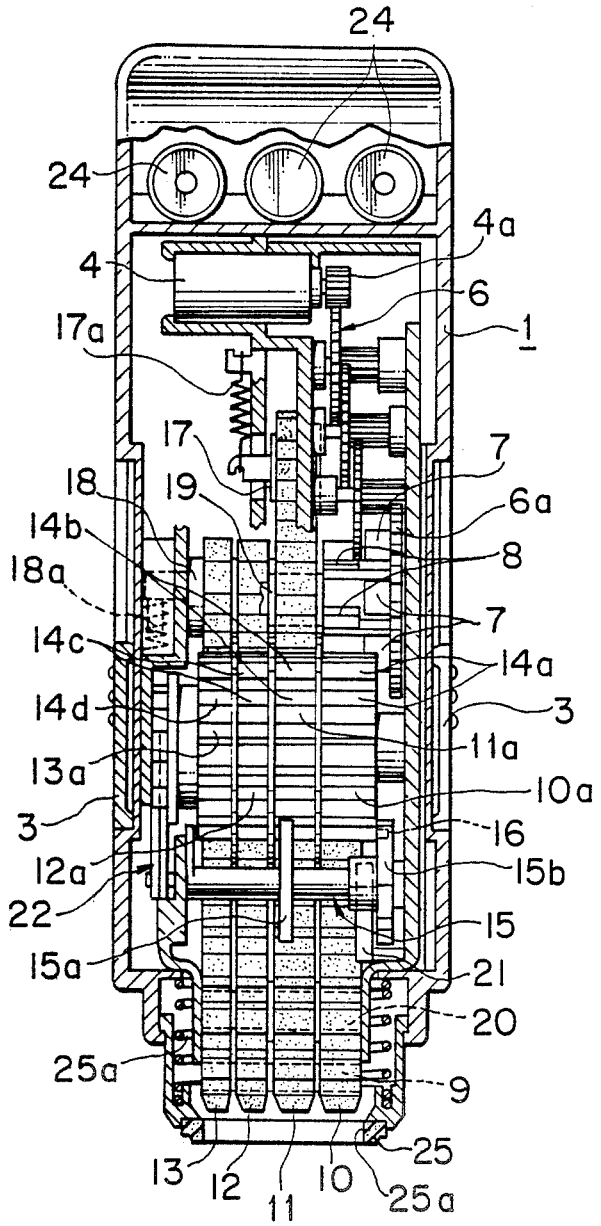
FIG. 1 is a front elevational view, partially broken away, of a date-stamping apparatus which is one embodiment of the present invention.
Figure 2:
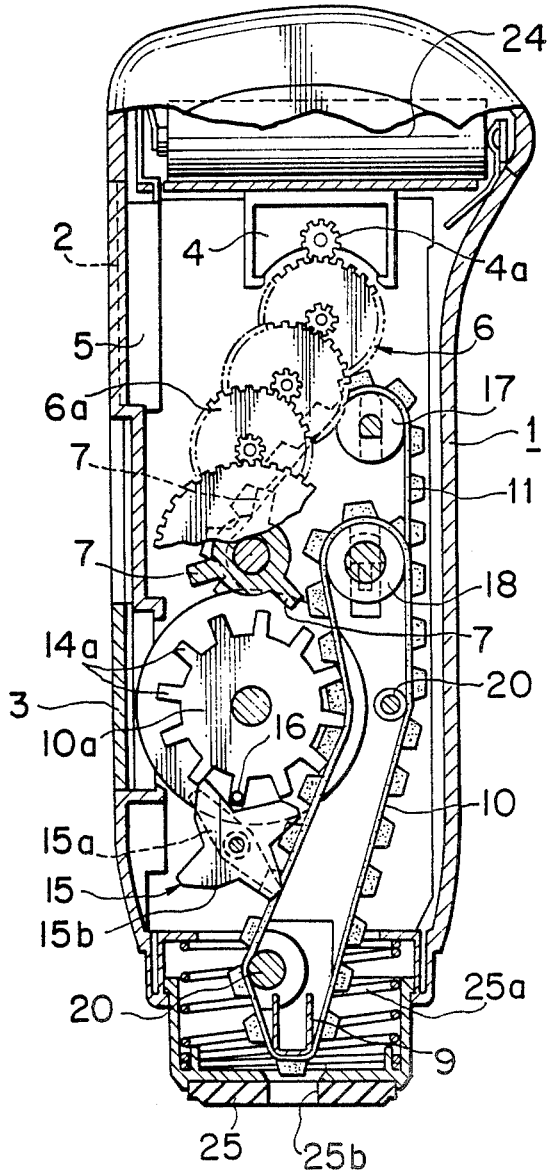
FIG. 2 is a side view, partially broken away, of the date-stamping apparatus shown in FIG. 1 as viewed from the right-hand side.
Figure 3:
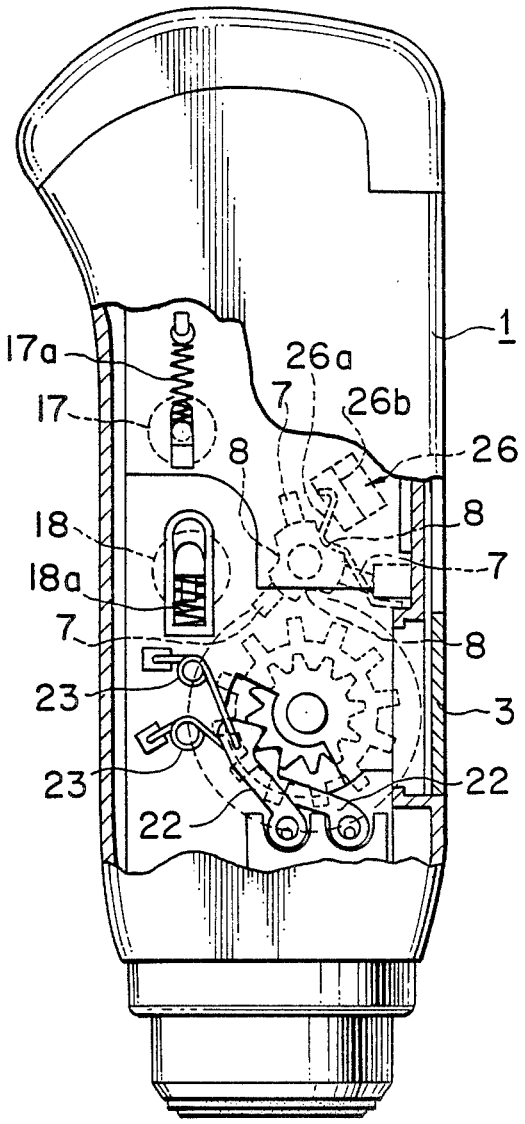
FIG. 3 is a side view, partially broken away, of the date-stamping apparatus shown in FIG. 1 as viewed from the left-hand side.

The present invention will now be described in connection with an embodiment illustrated in the drawings.

A date-stamping apparatus constructed according to the present invention comprises a casing (1) including a time display section (2) on its front and upper portion. The casing (1) also includes a cover (3) vertically slidably mounted on the casing (1) at its central portion to conceal belt feed wheels which will be described later. The casing (1) further includes a small electric motor (4) energized by clock signals from a timing circuit (5) at regular time intervals, and a reduction mechanism (6) including a plurality of gear wheels operatively connected with the motor (4). The gear wheels in the reduction mechanism (6) are engaged by a gear wheel (**4*a*) in the motor (4). The final gear wheel (6*a*) in the reduction mechanism (6) is provided with three engaging pawls (7) and three engaging grooves (8). The three engaging pawls (7) are angularly arranged with a spacing of 120 degrees from one another; the three engaging grooves are similarly arranged with a spacing of 120 degrees from one another. When one hour's time has passed one hour, each of the engaging pawls (7) is rotated to engage the corresponding engaging pawl (14*a*) on a time-printing belt driving wheel (10*a*) contacted by the external face of a time-printing belt (10). Thus, the time-printing belt driving wheel (10*a*) will be rotated by one notch corresponding to one hour. Reference numerals (10*a*), (11*a*), (12*a*) and (13*a*) respectively denote time-printing, day-printing, month-printing and year-printing belt driving wheels which are juxtaposed and journalled within the casing (1**).

Each of the belt driving wheels contacts, under pressure, with one side of a corresponding endless belt, e.g., time-printing, day-printing, month-printing and year-printing belts (10), (11), (12) and (13), respectively. Each of the belts is spanned between corresponding tension roller (17) or (18), and a bridge member (9), all of which will be described later. Each of the belt driving wheels (10*a*), (11*a*), (12*a*) and (13*a*) is provided with twelve engaging pawls (14*a*), (14*b*), (14*c*) and (14*d*) formed thereon at angular intervals of 30 degrees.

There is further provided a carrying wheel (15) having two-lobed cam (15*a*) and four-lobed cam (15*b*) formed therein in a juxtaposed fashion. When the four-lobed cam (15*b*) is moved through 180 degrees to engage a projection (16) on one of the engaging pawls (14*a*) of the time-printing belt driving wheel (10*a*) two times (after twenty-four hours through which the time-printing belt driving wheel (10*a*) has been rotated completely two times), two-lobed cam (15*a*) causes the day-printing belt driving wheel (11*a*) engaged by the printing face of the endless day-printing belt (11) to rotate by one notch. As a result, the endless day-printing belt (11) will be moved forward by one day.

The printing belts 10, 11, 12, 13 are made from cellular material. Absorption of stamping ink by the belts enables the date-stamping apparatus to continue stamping without stamp-pad contact. In another embodiment, only the stamping characters of the belts could be made from cellular material.

Reference numeral (17) designates a tension roller over which the day-printing belt (11) passes. This tension roller (17) is supported at each end of a spring (17*a*) for vertical fine-movement such that the endless day-printing belt (11) is always tensioned under a given tension. There is another tension roller (18) around which the endless time-printing, month-printing and year-printing belts (10), (12) and (13) are wound. Similarly, the tension roller (18) is supported at each end by a spring (18*a*) for vertical fine-movement such that a given tension will be always applied to each of the endless printing belts.

In the drawings, furthermore, reference numeral (19) denotes a guide roller around which the endless day-printing belt (11) is wound; (20) a guide roller around which the endless printing belts are wound; (21) a ratchet mechanism for preventing the carrying wheel (15) from being rotated in the backward direction; (22) a ratchet mechanism for preventing the belt driving wheels from being rotated in the backward direction; (23) a spring for biasing the ratchet mechanism (22); (24) a battery; and (25) a platen biased by the spring (25*a*). The platen (25) includes an opening (25*b*) through which the printing faces of the endless printing belts can be exposed externally during stamping. Reference numeral (26) designates a switch including a spring-biasing type movable contact (26*a*) and a stationary contact (26*b*). The motor (4) continues to be energized until the movable contact (26*a*) of the switch (26) is engaged by the engaging groove (8) of the final gear wheel (6*a*) and then disengaged from the stationary contact (26*b*).

It is now assumed that such a date-stamping apparatus has been set, for example, at 1:00 a.m. on Dec. 1, 1988. As the present time becomes 2:00 a.m., the motor (5) is energized by the timing circuit (5) to cause the engaging pawls (7) on the final gear wheel (6*a*) of the reduction mechanism (6) to engage the respective engaging pawls (14*a*) on the time-printing belt feed wheel (10*a*) around which the endless time-printing belt (10) is wound. Thus, the time-printing belt driving wheel (10*a*) will be rotated by one notch to move the 2 hour character on the endless time-printing belt (10) to the bottom face of the bridge member (9) whereat the two-hour letter will be displayed. At this time, the movable contact (26*a*) of the switch (26) engages the engaging groove (8) of the final gear wheel (6*a*) and then disconnected from the stationary contact (26*b*) to de-energize the motor (4). After one further hour, the similar cycle is repeated to display the 3 hour character on the endless time-printing belt (10) at the bottom face of the bridge member (9). Since the engaging pawl (14*a*) of the time-printing belt driving wheel (10*a*) includes the projection (16) functioned to rotate the four-lobed cam (15*b*) of the carrying wheel (15) through 90 degrees at twelve o'clock (noon), the two-lobed cam (15*a*) can be rotated through 180 degrees at the second twelve o'clock (in the next day) to rotate the day-printing belt feed wheel (11*a*) urged against the printing face of the endless day-printing belt (11) by one notch to forwardly move the endless day-printing belt (11) by an amount corresponding to one day. When one month has passed in such a manner, the cover (3) is opened to expose the belt driving wheels such that the belt driving wheel (14*c*) urged against the endless month-printing belt (12) can be manually rotated by one notch corresponding to one month.

As will be apparent from the foregoing, the present invention provides a date-stamping apparatus wherein the endless time-printing, day-printing, month-printing and year-printing belts are spanned between a bridge member on the lower portion of the casing and an upper tension roller, each of the endless belts having its external printing face urged against the peripheral engaging face of the corresponding belt driving wheel adapted to drive that endless printing belt and wherein the time-printing belt driving wheel is rotated by an electric motor through a reduction mechanism. Therefore, each of the belt driving wheels can be rotated at lower speed while moving the corresponding endless printing belt. As a result, no slippage will be created between each of the belt driving wheels and the corresponding endless printing belt. Furthermore, this provides another advantage in that the printing face of each of the printing belts can be engaged by one of the corresponding belt driving wheels without any damage. Since the date-stamping apparatus is of the endless belt type, it can use a compact casing. Even if any one of the endless printing belts is larger than the other belts, the whole belt assembly can be easily housed in such a compact casing. Thus, the date-stamping apparatus constructed according to the present invention has an increased practical value by overcoming all the problems of the prior art date-stamping systems.

What is claimed is:

1. A date-stamping apparatus comprising a casing, a bridge member located at a lower end of the casing, a tension roller located above the casing and biased upwardly, an endless date-printing belt having printing characters on its outside surface and spanned between the bridge member and the tension roller, a date-belt driving wheel located within the casing at a substantially intermediate portion thereof, said belt driving wheel, having a circumferential engagement section co-operating with the belt and engaging the outside surface of the belt, and an electric motor intermittently energized by a timing circuit and operatively connected with the belt driving wheel.

2. A date-stamping apparatus in accordance with claim 1, wherein said printing characters comprise cellular rubber.

3. A date-stamping apparatus in accordance with claim 1, further comprising a time-printing belt and a time-belt driving wheel; wherein the time-belt driving wheel is operably connected with the electric motor and the belt driving wheel is operably connected with the time-belt driving wheel through a carrying wheel; and wherein the belt driving wheel rotates by an amount corresponding to one day when the time-belt driving wheel is driven by an amount corresponding to 24 hours.

* * * * *